United States Patent [19]

McKnight, deceased et al.

[11] Patent Number: 5,036,255

[45] Date of Patent: Jul. 30, 1991

[54] BALANCING AND SHUNT MAGNETICS FOR GASEOUS DISCHARGE LAMPS

[76] Inventors: William E. McKnight, deceased, late of Richardson, Tex.; by Eileen M. McKnight, executrix, 1701 Arvada Dr., Richardson, Tex. 75081

[21] Appl. No.: 508,598

[22] Filed: Apr. 11, 1990

[51] Int. Cl.[5] ..... H05B 41/36

[52] U.S. Cl. ..... 315/258; 315/283; 315/294; 315/324; 315/DIG. 5

[58] Field of Search ..... 315/258, 294, 324, DIG. 5, 315/282, 283

[56] References Cited

U.S. PATENT DOCUMENTS

| | | | |
|---|---|---|---|
| 3,676,734 | 7/1972 | Shimizu et al. | 315/258 X |
| 4,006,384 | 2/1977 | Elms et al. | 315/DIG. 5 X |
| 4,158,156 | 6/1979 | Knoll | 315/DIG. 5 X |
| 4,163,925 | 8/1979 | Gyursanszky | 315/258 X |
| 4,630,005 | 12/1986 | Clegg et al. | 315/282 X |
| 4,933,605 | 6/1990 | Quazi et al. | 315/DIG. 5 X |
| 4,945,278 | 7/1990 | Chern | 315/DIG. 5 X |

*Primary Examiner*—Eugene R. LaRoche

*Assistant Examiner*—Do Hyun Yoo

*Attorney, Agent, or Firm*—Ross, Howison, Clapp & Korn

[57] ABSTRACT

In accordance with the present invention, a control device for energizing a lamp circuit including gaseous discharge lamps includes a power source having a variable amplitude varying in time. A control circuit is provided for producing a variable pulse width control signal. A switch is responsive to the variable pulse width control signal for providing a switched output from the power source. The switched output has a pulse width proportional to the variable pulse width control signal for supplying power to the lamp circuit. An inductor is interconnected between the switch and the lamp circuit. The inductor includes a first winding with a center tap for receiving the switched output from the switch for balancing the voltage and current applied to the lamps within the lamp circuit. The inductor further includes a second winding connected to the lamp circuit for providing constant lamp brightness regardless of amplitude variations in the source voltage.

3 Claims, 1 Drawing Sheet

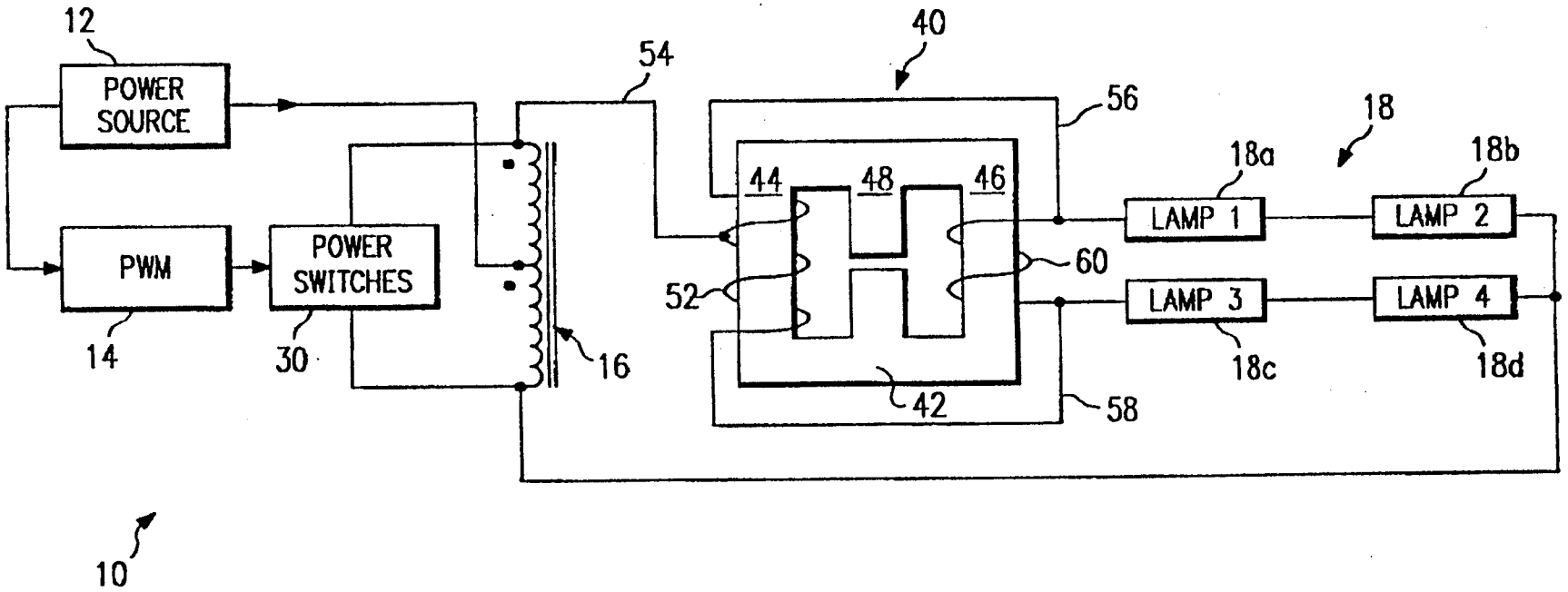
POWER SOURCE
12
PWM
14
POWER SWITCHES
30
16
54
52
44
48
46
42
40
56
60
58
LAMP 1
18a
LAMP 2
18b
LAMP 3
18c
LAMP 4
18d
18
10

BALANCING AND SHUNT MAGNETICS FOR GASEOUS DISCHARGE LAMPS

TECHNICAL FIELD OF THE INVENTION

This invention relates to a control circuit for operating gas discharge lamps such as high-intensity discharge lamps and fluorescent lamps, and more particularly, to a control circuit utilizing balancing and shunt magnetics for minimizing the effects of variations in the amplitude of the source voltage and for driving multiple lamps.

BACKGROUND OF THE INVENTION

The standard commercial lighting discharge device, such as, for example, fluorescent lamps and high pressure mercury vapor lamps, are characterized as negative resistance devices. During operation of these devices, a non-linear relationship exists between the current through the device and the voltage across the device. As used herein, the term "lamp" is intended to include gaseous discharge lamps such as high intensity discharge lamps and fluorescent lamps. Such lamps operate more efficiently in frequencies higher than 60 Hz. Typically, such frequencies may range from 15 KHz to as high as 100 KHz.

In order to obtain longer life and constant brightness for lamps designed for high frequency operation, the lamp current must be regulated to a higher degree than with prior ballast circuits. Problems exist in obtaining a highly regulated lamp current because, in a ballast intended for residential or commercial use, conventional 60 Hz line voltage is the typical power source. Even when full-wave rectified, so that a 60 Hz source in effect becomes a 120 Hz source, there is substantial variation in the amplitude of the source voltage fed to the power transformer which normally energizes the lamp load. If this variation in voltage amplitude is reflected in applied lamp current, an undesirable situation exists in reducing effective lamp life as well as resulting in uncontrolled variations in lamp brightness. Additionally, it is desired to operate multiple lamps utilizing a single power source. Due to the differences in operation of the individual lamps within a multi-lamp configuration, variations in lamp brightness will also result.

A need has thus arisen for a control device for gaseous discharge lamps operating in multiple lamp configurations such that lamp circuits operate over a wide variety of supply voltage levels without substantial fluctuations in the total power employed by the system to improve lamp life and provide constant brightness output of the individual lamps within the system.

SUMMARY OF THE INVENTION

In accordance with the present invention, a control device for energizing a lamp circuit including gaseous discharge lamps is provided. The control device includes a power source having a variable amplitude varying in time. A control circuit is provided for producing a variable pulse width control signal. A switch is responsive to the variable pulse width control signal for providing a switched output from the power source. The switched output has a pulse width proportional to the variable pulse width control signal for supplying power to the lamp circuit. An inductor is interconnected between the switch and the lamp circuit. The inductor includes a first winding with a center tap for receiving the switched output from the switch for balancing the voltage and current applied to the lamps within the lamp circuit. The inductor further includes a second winding connected to the lamp circuit for providing constant lamp brightness regardless of amplitude variations in the source voltage.

BRIEF DESCRIPTION OF THE DRAWING

For a more complete understanding of the invention and for further advantages thereof, reference is now made to the following Description of the Preferred Embodiment taken in conjunction with the accompanying Drawing which is a block diagram of the present control device.

DESCRIPTION OF THE PREFERRED EMBODIMENT

Referring to the Figure, a block diagram of the present control device is illustrated, and is generally identified by the numeral 10. Control device 10 includes a power source 12 which provides a voltage amplitude varying in time such as standard 60 Hz line power. Power source 12 may also include a full-wave rectifier circuit which receives the standard 60 Hz line power and converts this input into a full-wave rectified output signal of 120 Hz. The output of power source 12 is applied to a pulse width modulation control circuit 14 and to a transformer circuit 16. Transformer circuit 16 provides energization power to a lamp circuit generally identified by the numeral 18. Lamp circuit 18 includes lamps **18*a* and 18*b*, serially arranged, and lamps 18*c* and 18*d***, also serially arranged.

Pulse width modulation control circuit 14 produces a variable pulse width control signal which is applied to power switches 30. Power switches 30 may include, for example, a pair of power field effect transistors which are responsive to the output of pulse width modulation control circuit 14 for producing a switched output from power source 12 to transformer circuit 16. The switched output has a pulse width proportional to the variable pulse width control signal generated by pulse width modulation control circuit 14. Power switches 30 are gated to conduction respectively in alternate cycles based on the variable pulse width control signal for generating a high frequency electrical signal for supplying power to lamp circuit 18. Power switches 30 as well as transformer circuit 16 operate in a manner well-known to those skilled in the art for energizing gaseous discharge lamps within a lamp circuit. Pulse width modulation circuit 14 may comprise, for example, a model TL 494 manufactured and sold by Motorola, Inc., which operation is described in a publication entitled *Linear/Switchedmode Voltage Regulator Handbook. Theory and Practice,* published by Motorola, Inc., 1982 at pages 105–111 which description is hereby incorporated by reference.

An important aspect of the present invention is the use of an inductor, generally identified by the numeral 40 which is interconnected between transformer circuit 16 and lamp circuit 18. Inductor 40 includes a magnetic core 42 having parallel first and second legs, 44 and 46, respectively and a centrally disposed air-gapped leg 48. First leg 44 includes a winding 52 which is center tapped to receive the output of transformer circuit 16 via signal line 54. Winding 52 and inductor 40 provide a balanced output to lamp circuit 18 such that the voltage and current applied to lamps **18*a* and 18*b* are balanced with the voltage and current applied to lamps 18*c* and 18*d*. Winding 52 is coupled via signal lines 56 and 58 to a winding 60 disposed on second leg 46 of inductor 40. Winding 60 and inductor 40 provide a magnetic shunt to lamp circuit 18 to provide constant lamp 18 brightness regardless of amplitude variations of the voltage supplied by power source 12**.

It therefore can be seen that the present control device provides for a constant brightness output of multiple lamps within series lamp circuits for any command input over a wide range of AC line voltages.

Whereas the present invention has been described with respect to specific embodiments thereof, it will be understood that various changes and modifications will be suggested to one skilled in the art and it is intended to encompass such changes and modifications as fall within the scope of the appended claims.

What is claimed is:

1. A control device for energizing a lamp circuit including multiple gaseous discharge lamps comprising:

a power source having a variable amplitude varying in time;

control means for producing a variable pulse width control signal;

switch means responsive to said variable pulse width control signal for producing a switched output from said power source;

said switched output having a pulse width proportional to said variable pulse width control signal for supplying power to the lamp circuit;

an inductor interconnected between said switch means and the lamp circuit, said inductor having a first winding having first and second ends with a center tap for receiving said switched output from said switch means for balancing the voltage and current applied to the lamps within the lamp circuit, and a second winding having first and second ends, connected to the lamp circuit for providing constant lamp brightness regardless of amplitude variations occurring in said power source.

2. The control device of claim 1 wherein said inductor includes a single core having first and second legs and an air-gapped leg disposed between said first and second legs, said first leg including said first winding and said second leg including said second winding, the first and second ends of said first winding being interconnected to said first and second ends of said second winding.

3. The control device of claim 2 wherein said first end of said second winding is connected to a first series-connected pair of gaseous discharge lamps within the lamp circuit, and said second end of said second winding is interconnected to a second series-connected pair of gaseous discharge lamps within the lamp circuit.

* * * * *

UNITED STATES PATENT AND TRADEMARK OFFICE

CERTIFICATE OF CORRECTION

PATENT NO. : 5,036,255

DATED : July 30, 1991

INVENTOR(S) : William E. McKnight and Richard P. Stein

It is certified that error appears in the above-identified patent and that said Letters Patent is hereby corrected as shown below:

On the Title page

Inventors: William E. McKnight, deceased, late of Richardson, Tex.; by Eileen M. McKnight, executrix, 1701 Arvada Dr., Richardson, Tex. 75081; and

Signed and Sealed this

Twenty-sixth Day of January, 1993

*Attest:*

STEPHEN G. KUNIN

*Attesting Officer*

*Acting Commissioner of Patents and Trademarks*